US006612672B2

(12) United States Patent
Yasuda

(10) Patent No.: US 6,612,672 B2
(45) Date of Patent: Sep. 2, 2003

(54) INK JET PRINTING APPARATUS AND INK JET PRINTING METHOD

(75) Inventor: Midori Yasuda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/998,224

(22) Filed: Dec. 3, 2001

(65) Prior Publication Data

US 2002/0097286 A1 Jul. 25, 2002

(30) Foreign Application Priority Data

Dec. 4, 2000 (JP) ..... 2000-369105

(51) Int. Cl.[7] ..... B41J 29/38; B41J 2/05
(52) U.S. Cl. ..... 347/12; 347/58
(58) Field of Search ..... 347/12, 50, 58

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/56 |
| 4,740,796 A | | 4/1988 | Endo et al. | 347/56 |
| 6,409,315 B2 | * | 6/2002 | Komuro | 347/58 |
| 2002/0003557 A1 | * | 1/2002 | Miyakoshi et al. | 347/58 |

FOREIGN PATENT DOCUMENTS

| | | | |
|---|---|---|---|
| JP | 54-056847 | 5/1979 | B41M/5/06 |
| JP | 59-123670 | 7/1984 | B41J/3/04 |
| JP | 59-138461 | 8/1984 | B41J/3/04 |
| JP | 60-071260 | 4/1985 | B41J/3/04 |

* cited by examiner

*Primary Examiner*—Hai Pham
*Assistant Examiner*—Alfred E. Dudding
(74) *Attorney, Agent, or Firm*—Fitzpatrick, Cella, Harper & Scinto

(57) ABSTRACT

This invention provides an ink jet printing apparatus and method with an inexpensive arrangement that allows a stable supply of an appropriate voltage to heaters without requiring varying load resistance or changing a power supply voltage. The ink jet printing apparatus of this invention has a plurality of nozzles arrayed in a print head; a plurality of energy generators installed one in each of the nozzles for generating an ejection energy to eject ink from the nozzles, the plurality of energy generators being divided into a plurality of blocks; and a drive controller f or simultaneously driving the energy generators in each block. The drive controller supplies an energy to the energy generators making up each block through different kinds of energy supply paths.

10 Claims, 6 Drawing Sheets

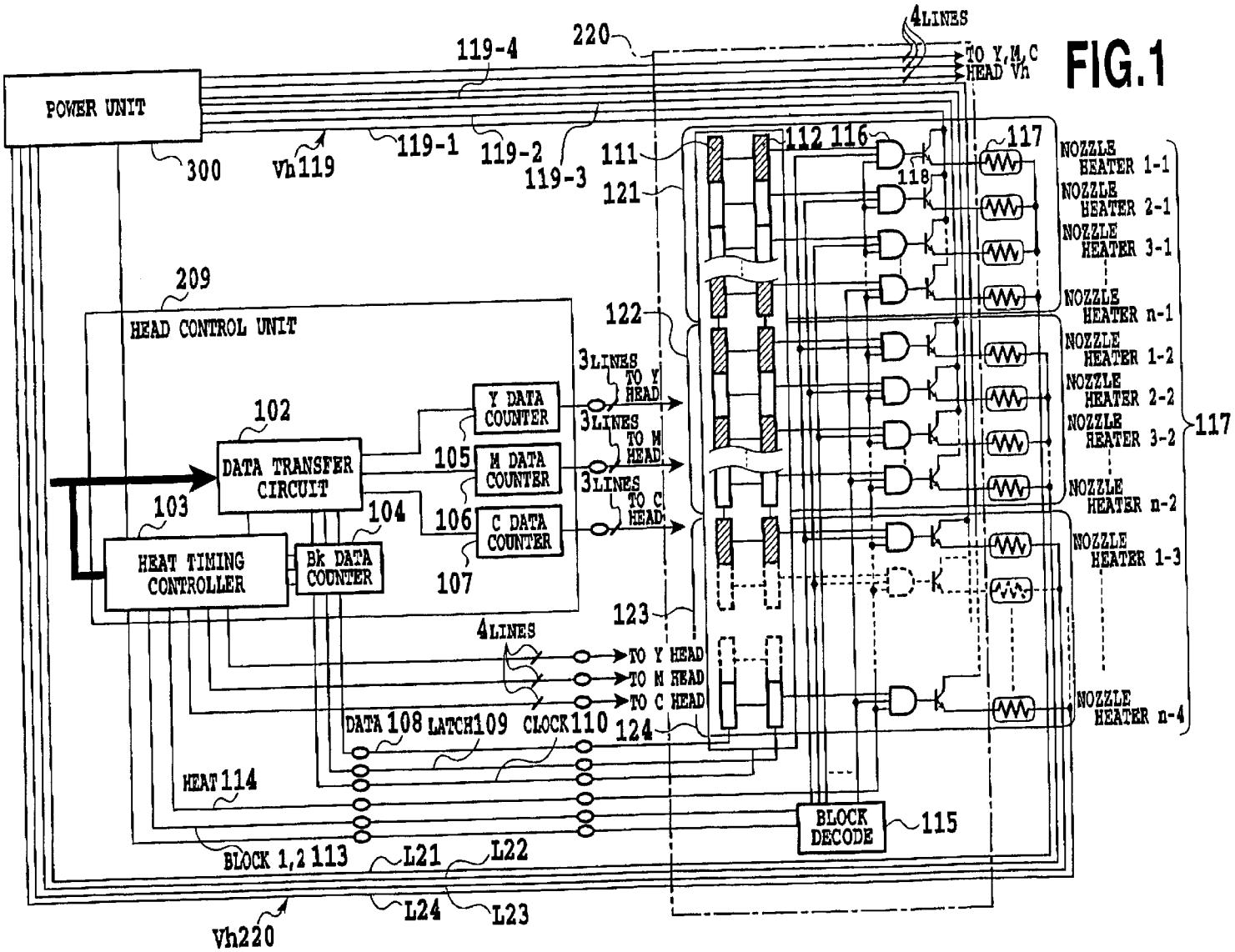
FIG.1
NOZZLE HEATER 1-1
NOZZLE HEATER 2-1
NOZZLE HEATER 3-1
NOZZLE HEATER n-1
NOZZLE HEATER 1-2
NOZZLE HEATER 2-2
NOZZLE HEATER 3-2
NOZZLE HEATER n-2
NOZZLE HEATER 1-3
NOZZLE HEATER n-4
117
4LINES
TO Y,M,C HEAD Vh
118
116
112
115
BLOCK DECODE
111
121
122
123
124
3LINES TO Y HEAD
3LINES TO M HEAD
3LINES TO C HEAD
TO Y HEAD
TO M HEAD
TO C HEAD
220
119-4
119-1
119-2
119-3
Vh119
300
POWER UNIT
209
HEAD CONTROL UNIT
102
DATA TRANSFER CIRCUIT
103
HEAT TIMING CONTROLLER
104
Bk DATA COUNTER
105
Y DATA COUNTER
106
M DATA COUNTER
107
C DATA COUNTER
4LINES
DATA 108 LATCH109 CLOCK110
L21
L22
L23
L24
BLOCK 1,2 113
HEAT114
Vh220

INK JET PRINTING APPARATUS AND INK JET PRINTING METHOD

This application is based on Patent Application No. 2000-369105 filed Dec. 4, 2000 in Japan, the content of which is incorporated hereinto by reference.

BACKGROUND OF THE INVENTION

1. Field of the Invention

The present invention relates to an ink jet printing apparatus, and more particularly to an ink jet printing apparatus and an ink jet printing method which eject ink by an energy generated by an electrothermal transducer.

2. Description of the Related Art

Generally, the ink jet printing apparatus performs printing by relatively moving an ink jet print head over a print medium while ejecting ink from the head. In the ink jet printing apparatus, a quality of the printed result depends on such factors as a control of a relative speed between the print head and the print medium, a control of an ejection timing associated with the relative speed control, and a stability of power supply to the print head. The ink jet printing apparatus is classed into a serial type and a full-line type according to the type of the print head used. The serial type is a widely used printing apparatus in which the print head is reciprocally moved in a direction crossing a print medium feeding direction while ejecting ink from the head.

There are several types of print head, including one which ejects ink by activating a piezoelectric element and a so-called bubble jet type which generates a bubble by an instant surface boiling and ejects ink by using a pressure of the bubble as an ejection energy. The print head of the bubble jet type causes the surface boiling of ink by energizing a heater installed near an ink ejection nozzle in an ink path.

In such ink jet printing apparatus, it is important in keeping the print quality satisfactory that the energy for ejecting ink be supplied stably at all times to eject the ink under the same condition and thereby produce uniform ink droplets. However, the number of heaters that are energized simultaneously is not fixed but changes according to a duty ratio of image data. Hence, the heater driving condition varies, affected by voltage variations due to changes in an output current of the power supply and by variations in voltage drop due to resistance component changes in a power supply system.

Hence, in conventional ink jet printing apparatus, it is common practice to enhance the precision of power supply output and construct the power supply system with as little loss as possible so that the printing apparatus can be operated in a range that can meet the ejection requirements.

As color image handling is made easy by increased speeds of personal computers in recent years, the amount of data to be processed and the processing speed are increasing rapidly.

Although the speed of the ink jet printing operation can be enhanced by increasing the ink ejection frequency and the number of nozzles that can be energized simultaneously, this gives rise to a problem that a change in the number of nozzles that are energized simultaneously in the actual printing operation becomes large. That is, of the nozzles that can be energized at one time, the number of nozzles used in the actual printing operation changes according to the image data being printed. When the number of nozzles that can be energized simultaneously is increased to enhance the printing speed as described above, the number of nozzles energized simultaneously varies greatly depending on the image data.

For example, when printing a black solid image, all the nozzles that can be energized for simultaneous ink ejection are used. When printing a low-duty image, such as lines, only a part of the available nozzles are used for simultaneous ink ejection. In this way, the number of nozzles that are driven simultaneously varies depending on the image data. This variation becomes more conspicuous as the total number of nozzles in the print head increases. The difference (or change) in the number of nozzles that need to be driven simultaneously results in a difference (or change) in the current that needs to be supplied to the ejection energy generating means such as heaters.

A circuit for supplying electricity to the ink jet print head for ink ejection has a resistance component, such as contact resistance with a connector and its own wiring resistance. Hence, when the heaters are in a conducting state, the voltage applied to the print head drops in proportion to the current because of the heater resistance component. If the current changes greatly as a result of a change in the number of simultaneously energized nozzles, the drive voltage applied to the heaters of the print head also changes, posing a problem that the ink ejection cannot be performed under the same condition. That is, as the change in the drive voltage increases, the resulting variations in the ink ejection condition greatly influence the print quality, which is detrimental to improving the speed of the printing operation. Therefore, if an ink ejection control which can keep the ejection condition from changing according to the print data is possible, the speed of the printing operation can be increased.

To realize such an ink ejection control, image recording apparatus have been proposed and practiced, which include one comprising a count means for counting print data to monitor the number of nozzles that are actually energized for ink ejection and an output voltage changing means for changing the output voltage of a power supply according to the count value, and one comprising the count means, a variable resistance load means for changing a resistance in a power supply circuit to the print head, and a control means for setting a value of the variable resistance according to the count value.

In these printing apparatus, a control is made in such a way that when the number of simultaneously energized nozzles is large, the resistance value of the variable resistance load means is reduced and that when the number of simultaneously energized nozzles is small, the resistance value is increased. This arrangement can control the voltage drop caused when the current flowing through the heaters passes through this variable resistance load means, thereby keeping the voltage applied to the heaters during ink ejection constant and the ejection condition uniform.

The image forming apparatus described above that counts the number of simultaneously energized nozzles, however, has the following problem. That is, although the count value can be monitored easily since it is a digital quantity, the variable resistance load means easily experience characteristic variations and degradation of characteristics over time, so that simply performing the control based on the energized nozzle count value cannot achieve an accurate control nor a satisfactory print quality.

SUMMARY OF THE INVENTION

An object of the present invention is to provide an ink jet printing apparatus and method with an inexpensive arrangement that allows a stable supply of an appropriate voltage to heaters without requiring a variable resistance load means or a power supply voltage changing means.

According to one aspect the present invention provides an ink jet printing apparatus which comprises: a plurality of nozzles arrayed in a print head; a plurality of energy generating means for generating an ejection energy to eject ink from the nozzles, the plurality of energy generating means being divided into a plurality of blocks; and a drive control means for supplying an energy through an energy supply path to the energy generating means in each block simultaneously; wherein the drive control means supplies an energy to at least a part of the energy generating means making up each block through a plurality of different kinds of the energy supply paths.

That is, the Ink jet printing apparatus of this invention has a plurality of nozzles arrayed in a print head; and a plurality of energy generating means for generating an ejection energy to eject ink from the nozzles; wherein the energy generating means have a plurality of energy supply paths and a drive control means for simultaneously driving a part of the plurality of the energy generating means. This apparatus is characterized in that the plurality of the energy generating means connected, in one-to-one relationship, to n different supply paths constitute one block and that the drive control means is so arranged as to simultaneously drive as the same block the energy generating means each forming an element of each one of different groups.

According to another aspect, the present invention provides an ink jet printing apparatus which comprises: a plurality of nozzles arrayed in a print head; and a plurality of energy generating means for generating an ejection energy to eject ink from the nozzles; wherein the print head having the energy generating means has a wiring pattern formed on a heater board therein in such a way that wiring resistances of energy supply paths running to different nozzles are equal.

According to still another aspect, the present invention provides an ink jet printing apparatus which comprises: a plurality of nozzles arrayed in a print head; and a plurality of energy generating means for generating an ejection energy to eject ink from the nozzles; wherein the print head having the energy generating means is mounted on each of a plurality of carriages that move on different moving paths, and a long power supply path connecting to the print heads mounted on one of the carriages is formed with a wire material of a lower electric resistance than that of a wire material of a short power supply path connecting to the print heads mounted on another carriage.

According to a further aspect, the present invention provides a printing method which comprises the steps of: dividing a plurality of energy generating means into a plurality of blocks, the energy generating means being adapted to generate an ejection energy to eject ink from nozzles; and simultaneously energizing the energy generating means in each block to perform printing; wherein a control is performed to supply an energy to at least a part of the energy generating means making up each of the blocks through a plurality of different kinds of energy supply paths.

As described above, with this invention, since a stable supply of electricity can be made through a plurality of head drive power supply paths, without being affected by a change in the number of nozzles that are simultaneously energized, the ink ejection condition remains stable assuring the printing of high-quality images.

Further, even when the head drive power supply paths differ in length, their wiring resistances can be made equal, keeping the ejection conditions uniform among different nozzles and thus assuring the printing of high-quality images.

The above and other objects, effects, features and advantages of the present invention will become more apparent from the following description of embodiments thereof taken in conjunction with the accompanying drawings.

BRIEF DESCRIPTION OF THE DRAWINGS

FIG. 1 is a block diagram showing a characteristic configuration of a first embodiment of the present invention;

DETAILED DESCRIPTION OF PREFERRED EMBODIMENTS

Now, embodiments of the present invention will be described by referring to the accompanying drawings.

(First Embodiment)

A first embodiment of this invention will be explained.

Figure 3:
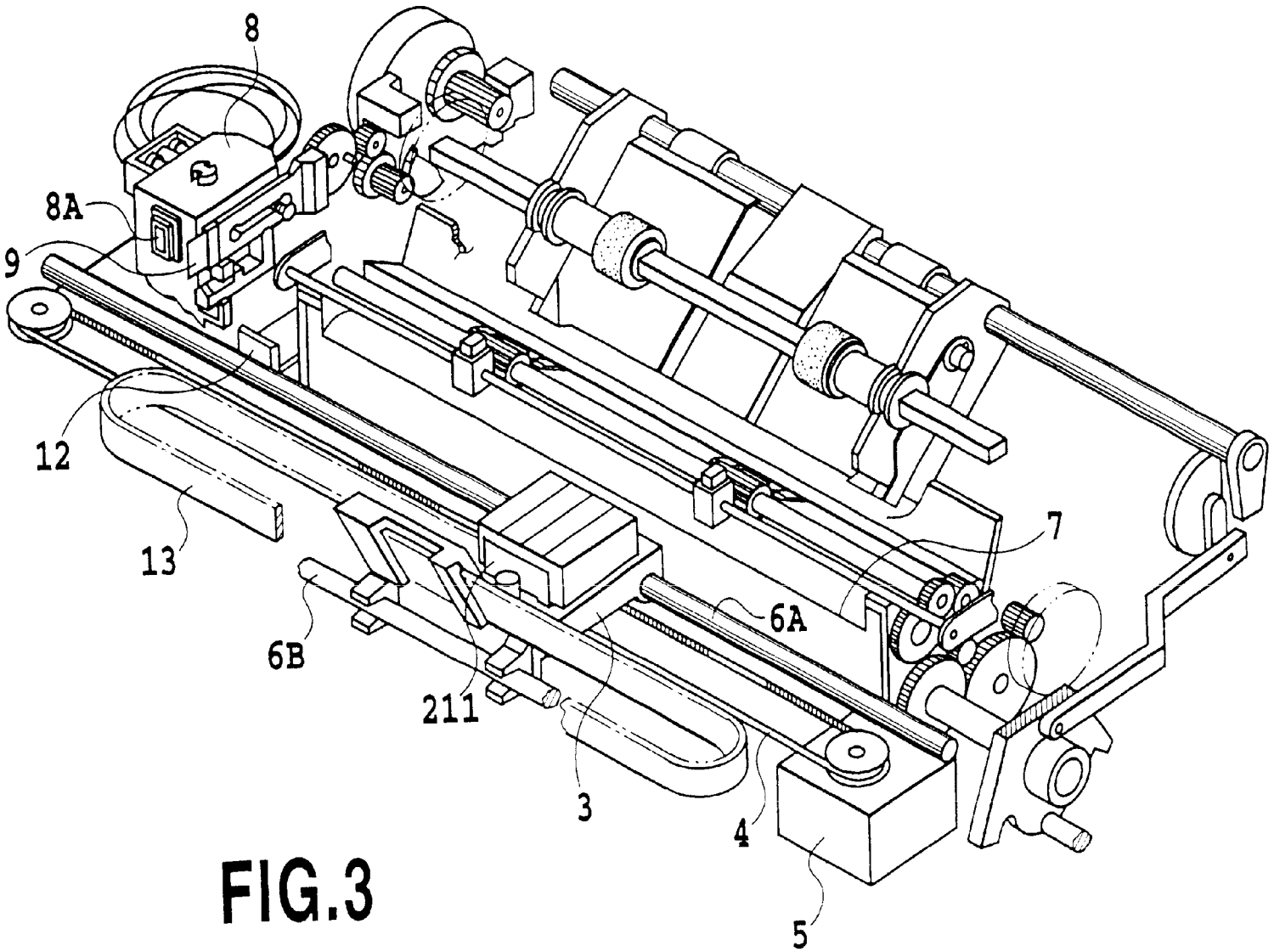
FIG. 3 is a perspective view showing a construction of a mechanism portion of the ink jet printing apparatus.

As shown in FIG. 3, in the ink jet printing apparatus of this embodiment, a carriage 3 is slidably attached along the guide shafts 6A, 6B arranged parallel to a direction of scan. This carriage 3 mounts on it four ink jet print heads 211 (black (BK) head 213, yellow (Y) head 214, magenta (M) head 215 and cyan (C) head 216) for associated ink colors and four ink tanks integrally attached to the associated print heads. A home position sensor (HP sensor) 8 is installed at one end of the apparatus to optically detect when the carriage 3 is at a home position.

The carriage 3 is connected to a part of a drive belt 4 that transmits a driving force of a carriage drive motor 5 to the carriage so that it is reciprocally moved along the guide shafts 6A, 6B by the driving force of the carriage drive motor 5.

A sheet of print paper (print medium) is fed from a medium supply unit not shown onto a platen 7 arranged opposite ejection surfaces of the print heads 211. The print paper feeding operation is performed intermittently and repetitively after each reciprocal motion of the carriage 3 to allow the print heads to eject ink during the forward or backward movement according to image data to form an image on the print paper.

The ink jet print heads 213–216 have a number of narrow pipe-shaped ink ejection nozzles arranged in the ejection surfaces facing a print surface of the print paper Heaters as ejection energy generating means for generating energy to eject ink are provided one in each of the nozzles near the nozzle outlets. The nozzle outlets of the print heads 213–216 are arrayed in a direction perpendicular to the scan direction of the carriage 3. The four print heads 213–216 are arranged side by side in the carriage scan direction.

The HP sensor 8 detects a reference position detection projection 12 when the carriage 3 slides along the guide shaft 6A, 6B in the initial stage of operation. The result of detection is used to determine the carriage home position HP, which represents a reference position in the scan direction for the printing operation.

In the ink jet printing apparatus, the print control unit not shown which will be described later receives the image information and control command data entered from an external host device and unfolds the image data into data of each color component. Then, the print control unit transfers the unfolded image data to the print heads and at the same time performs a series of printing operations of scanning the carriage 3 and ejecting ink at required timings.

The print control unit and the carriage 3 are connected to each other by a flexible cable 13 as power supply paths.

Next, the print control unit in the ink jet printing apparatus of this embodiment will be explained by referring to FIG. 2.

Figure 2:
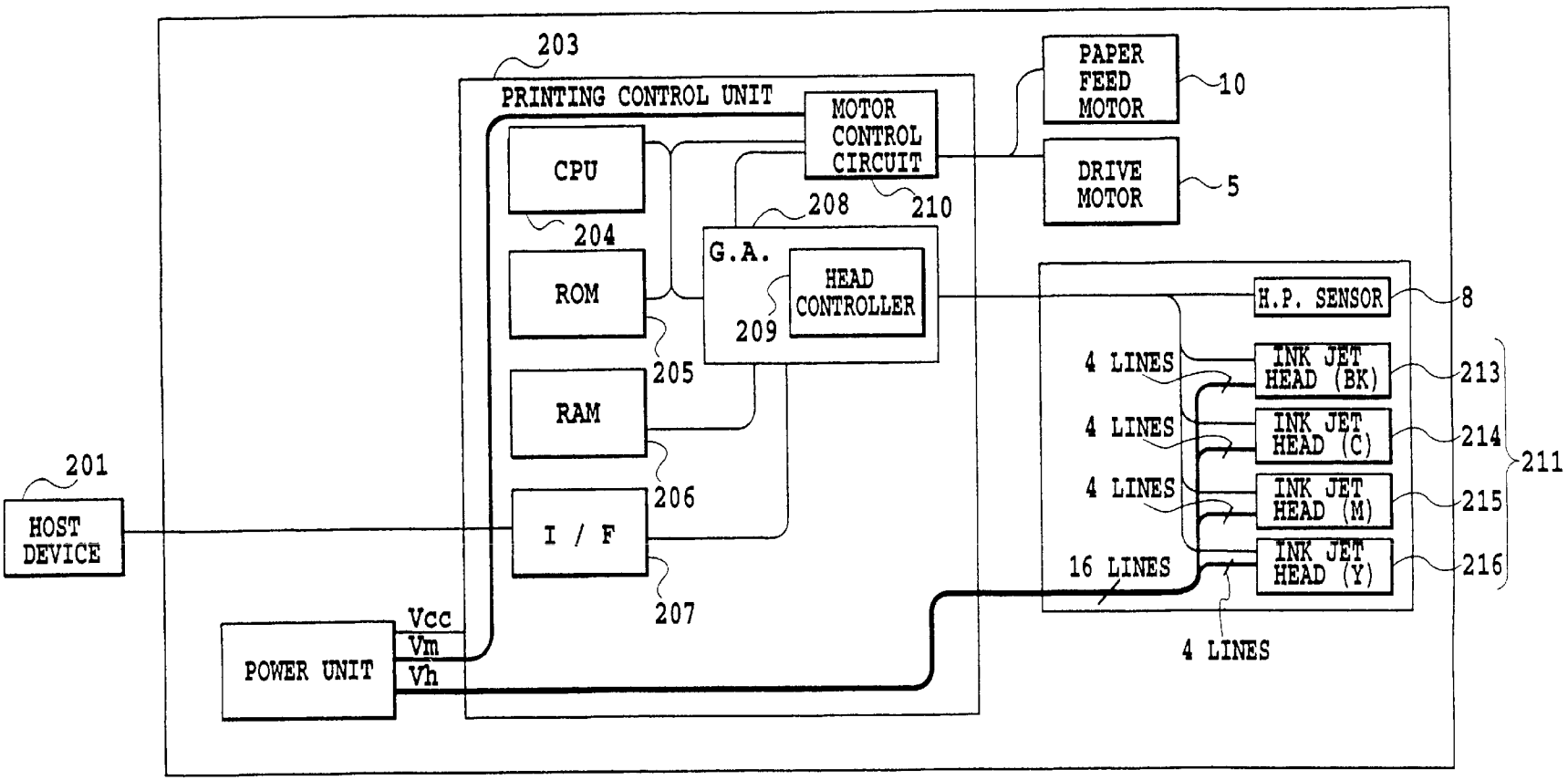
FIG. 2 is a block diagram schematically showing an overall configuration of an ink jet printing apparatus.

The print control unit 203 shown in FIG. 2 comprises a CPU 204, ROM 205 and RAM 206 as memory units, an interface circuit 207 interfacing with an external host device 201, a motor control circuit 210 for driving the paper feed motor 10 and the carriage drive motor 5, and a gate array (G.A.) 208 as a logic circuit for performing a variety of controls to support the operation of the CPU 204. A head control unit 209 for controlling the ink ejection timing and executing the ink ejection from the print heads 211 is formed in the gate array 208.

The carriage drive motor 5 uses a stepping motor. The CPU 204 issues a drive signal for the carriage drive motor 5 to the motor control circuit 210 to move the carriage 3, and at the same time counts the number of drive signals from the main scan direction reference position to determine the current position of the carriage 3 in the main scan direction. When the carriage 3 reaches the position where the print heads 213–216 are to eject ink, the head control unit 209 energizes the heaters to eject ink.

Although in this embodiment the current printing position in the main scan direction is detected by counting the drive pulses of the motor, there is a known printing apparatus which determines the printing position by using a linear encoder having a scale arranged in the main scan direction.

The CPU 204 also performs an overall control on the operation of the ink jet printing apparatus according to a program preinstalled in the ROM 205 or a control command entered from the host device 201 through the interface circuit 207. The ROM 205 stores programs to be run by the CPU 204, various table data necessary for head control, and character data for generating character-based information.

The interface circuit 207 allows for the transfer of control commands from the host device 201 to the ink jet printing apparatus and the input/output of control data between them. The RAM 206 includes a work area used by the CPU 204 for calculation and a temporary storage area for the print data and control code entered from the host device 201 through the interface circuit 207. It also includes a print buffer in which the print data, after having been developed into bit data corresponding to the nozzles of the print heads, is stored.

Next, the ejection drive circuit and the ejection control of the print heads 211 will be described in more detail.

In this embodiment four heads mounted on the carriage 3 are used as described above. Because the operation principles for all print heads are the same, the print head (BK) 214 for ejecting a black ink Is taken for example.

In this embodiment, each print head is formed with a plurality of nozzles, each of which has a nozzle heater (energy generating means) 117 arranged therein. These nozzle heaters 117 are divided into a plurality of heat blocks (n-blocks in this case) according to the drive timing. Each heat block has 4 nozzle heaters that are to be energized simultaneously.

That is, in FIG. 1 a first heat block consists of nozzle heaters 1-1, 1-2, 1-3, 1-4 a second heat block consists of nozzle heaters 2-1, 2-2, 2-3, 2-4, a third heat block consists of nozzle heaters 3-1, 3-2, 3-3, 3-4, and a fourth heat block consists of nozzle heaters 4-1, 4-2, 4-3, 4-4, . . . and, n-1, n-2, n-3, n-4.

The nozzles on the print head are arranged in line and the nozzle heaters on the print head are also arranged in line. The nozzle heaters in the same heat block are arranged in the order of ascending nozzle number at every n position in the line of nozzle heaters. For example, the first nozzle in the first heat block 1-1 is followed by the first nozzle in the second heat block 2-1, which is followed by the first nozzle in the third heat block 3-1, which is followed by the first nozzle in the fourth heat block 4-1 . . . and which is followed by the first nozzle in the n-th heat block n-1. This is further followed by the second nozzle in the first heat block 1-2 and so on.

Of the arrangement number attached to each nozzle heater, a number preceding the hyphenation (-) denotes a heat block number whose nozzle heaters are energized simultaneously and a number following the hyphenation (-) denotes a group number whose nozzle heaters have the same power supply. Thus each nozzle heater can be identified by the block number and the group number.

One end of each nozzle heater is connected to the power unit (energy source) 300 through a drive transistor 118 and a power supply path Vh119. The power unit 300 comprises a plurality of sub-power supplies that correspond in one-to-one relationship to the power supply paths to protect each of the power supply paths Vh119-1, 2, 3, 4 against possible electric fluctuations. This arrangement ensures stably supply of electricity to each power supply path.

The power supply path Vh119 has n wires (wire 119-1, 119-2, 119-3, 119-4). The wire 119-1 is connected through the drive transistor 118 to the nozzles of first group 121, the wire 119-2 to the nozzles of second group 122, the wire 119-3 to the nozzles of third group 123, and the wire 119-4 to the nozzles of fourth group 124.

Also, the stabilization circuit corresponding to each power supply path can be prepared instead of the sub power supply to compensate electric change.

The opposite end of each nozzle heater 117 is connected to a power supply path Vh220 of the power unit 300. The power supply path Vh220 has four wires (wire L21–L24) each connected to the associated nozzle group of nozzle heaters. That is, the wire L21 Is connected to nozzle heaters 1-1, 2-1, . . . , n-1 belonging to the first group 121, the wire L22 to nozzle heaters 1-2, 2-2, . . . , n-2 belonging to the second group 122, the wire L23 to nozzle heaters 1-3, 2-3, . . . , n-3 belonging to the third group 123, and the wire L24 to nozzle heaters 1-4, 2-4, . . . , n-4 belonging to the fourth group 124.

The energizing of each nozzle heater 117, i.e., the supply of current, is done by switching the drive transistor 118. The drive transistor 118 is turned on or off by a head controller 209 and a nozzle selector 220

The head controller 209 outputs an image data signal 108, a clock signal 110 and a latch signal 109 through a data circuit of each color (Bk data circuit 104, Y data circuit 105, M data circuit 106 and C data circuit 107) to the nozzle selector 220 for each color print head in order to issue ejection data to the corresponding color print heads.

The nozzle selector 220 comprises a shift register 111, a latch circuit 112 and an AND circuit 116. The shift register 111 and the latch circuit 112 each have bits corresponding in one-to-one relationship to the nozzle heaters 117, with adjoining n bits forming each group 121, 122, . . . These groups 121, 122, . . . correspond to the first groups second group, . . . of nozzle heaters respectively. The shift register 111 receives image data 108 and a clock signal 110 from a data transfer circuit 102 through the Bk data circuit 104. The latch circuit 112 is supplied a latch signal 109.

The AND circuit 116 has three input terminals and is interposed between each bit of the latch circuit and the drive transistor 118. The AND circuit 116 has its output terminal connected to a base of the associated transistor 118 and one of its input terminals connected with an output of the latch circuit 112. The AND circuit 116 has another input terminal supplied with an output signal from a block decoder 115 and a third input terminal supplied with a heat signal 114.

The head controller 209, the nozzle selector 220, and power supply paths Vh119, Vh220 together form a drive control unit.

In the ink jet printing apparatus of the above construction, as shown in FIG. 2, the image data entered from the host device 201 through the interface circuit 207 is, as described earlier, stored temporarily in the RAM 206 and then read by the head controller 209 and supplied to the data transfer circuit 102 and a heat timing controller 103. The data transfer circuit 102 outputs the data signal 108, latch signal 109 and clock signal 110. The data signal 108 is successively transferred to each bit of the shift register 111 in synchronism with the clock signal. When data for all nozzle heaters is stored in the shift register 111, the latch signal 109 is input to the latch circuit 112 to complete the data setting.

With the data setting completed, the heat timing controller 103 outputs a pair of block selection signals 113 and a heat signal 114 according to the position of the carriage 3. Based on the pair of block selection signals 113, the block decoder 115 outputs a signal that activates a predetermined input of the AND circuit 116 corresponding to the block that needs to be driven.

When the heat signal 114 is input to the nozzles for which the data setting and block selection were made according to the procedure described above, the AND circuit 116 produces its output to turn on the drive transistor 118 connected to the nozzle heater 117 of each nozzle, supplying the drive current to the nozzle heaters. The heat signal 114 is used to control the actual heating duration for temperature control.

By successively repeating the sequence of operations described above, ink droplets can be ejected onto desired positions on the print medium during a series of printing operations.

Figure 4:
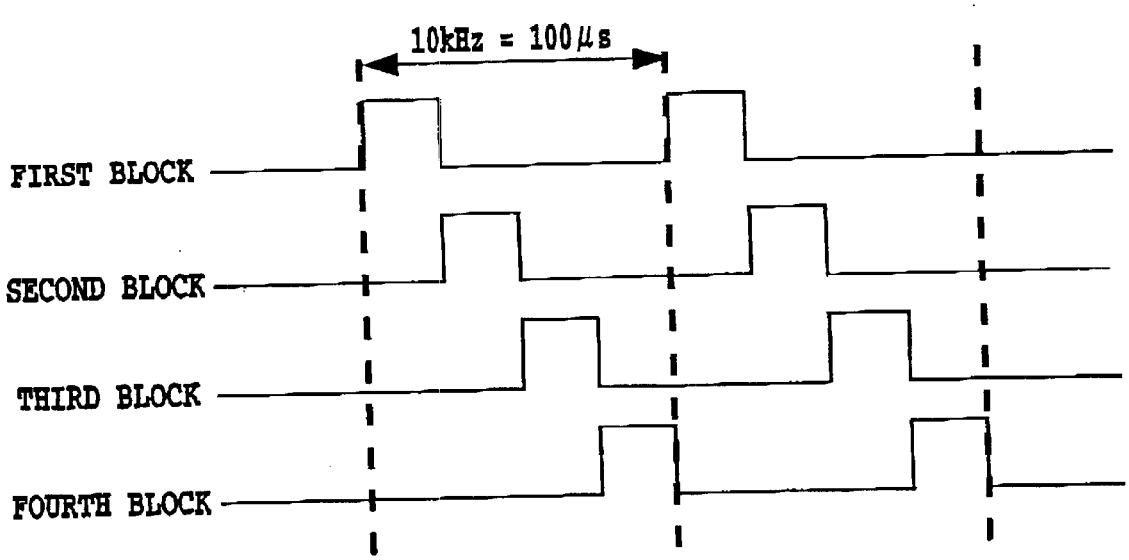
FIG. 4 is a timing chart showing output timings of heat signals in first to fourth heat blocks.

The plurality of the nozzle heaters in the print head 214 are not driven all at one time but are time-divided for operation at staggered times in order to spread the supply of the energy required for ink ejection. This time division driving of the nozzle heaters is done by differentiating the output timings of the heat signal 114. For the time-division driving, the nozzle heaters of the print head 214 are divided according to the blocks mentioned above. For example, when the head ejection frequency is 10 kHz, the first to fourth block are energized at different timings as shown in FIG. 4.

Four nozzle heaters in each block can be energized simultaneously by the data entered. For example, when the block decoder outputs a selection signal corresponding to a specified block, two input terminals of each AND circuit 116 belonging to that block are made active by the selection signal and the heat signal. Hence, if the bits in the latch circuit 112 that correspond to the selected block are all set with data, all three input terminals of each of all the AND circuits 116 corresponding to these bits become active, producing outputs. As a result, all the nozzles heaters of one block are simultaneously energized through the drive transistors 118.

Therefore, even when the number of nozzles that need to be driven simultaneously changes due to presence or absence of data or variation in the duty ratio, the magnitude of change is reduced to one fourth because the change is divided among the four blocks sub-power supplies. This can prevent the power supply voltage of the power unit from changing significantly, making it possible to maintain a constant ejection condition at all times and therefore form an image with high quality.

Figure 6:
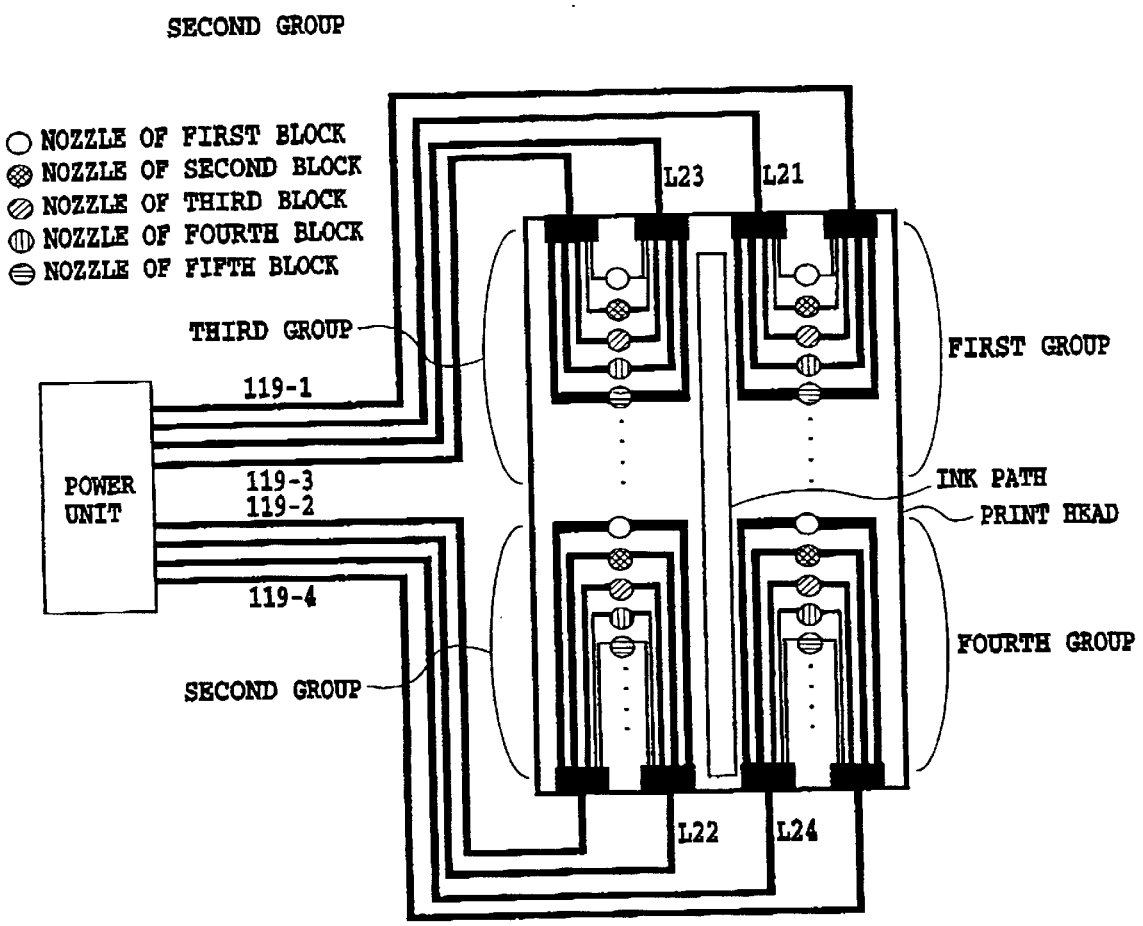
FIG. 6 is a block diagram showing power supply paths from a power unit to the print head.

FIG. 6 shows the connection between one of the print heads and the power supply paths Vh119-1, 119-2, 119-3, 119-4 for the four groups that are supplied by the power unit 300, and also shows how the power supply paths are wired on the heater board in the print head 214. When the power supply paths bundled and wired up to the print head 214 are separately wired to individual nozzle heaters, a wire pattern on the heater board is formed as follows. The wire to a nozzle nearest the power supply side is formed smallest in width and the wire to a nozzle farthest from the power supply side is formed largest in width in order to ensure that the resistances of the wires running from the end face of the print head to the different nozzles are equal. This arrangement realizes a stable supply of electricity to all nozzle heaters regardless of their distances from the end face of the print head.

Although the above embodiment has described a case where four power supply paths corresponding to four groups are independently provided as the energy generating means, the number of power supply path groups may be increased or decreased as required. It is also possible to provide the same number of power supply paths as the total number of nozzle heaters. The present invention is not limited to the above embodiment.

Further, the number of nozzles that are driven simultaneously is not limited to that of this embodiment and may be determined as required. While this embodiment has been described to use a serial type ink jet printing apparatus, this invention is not limited to this type but may be applied to a printing apparatus with a full-line type print head.

(Second Embodiment)

A second embodiment of this invention will be described.

While in the first embodiment n blocks of simultaneously driven nozzle heaters are each provided with an independent energy supply path, the second embodiment is characterized by an arrangement which, when the lengths of these independent power supply paths differ from each other, keeps impedances of these paths equal.

Figure 5:
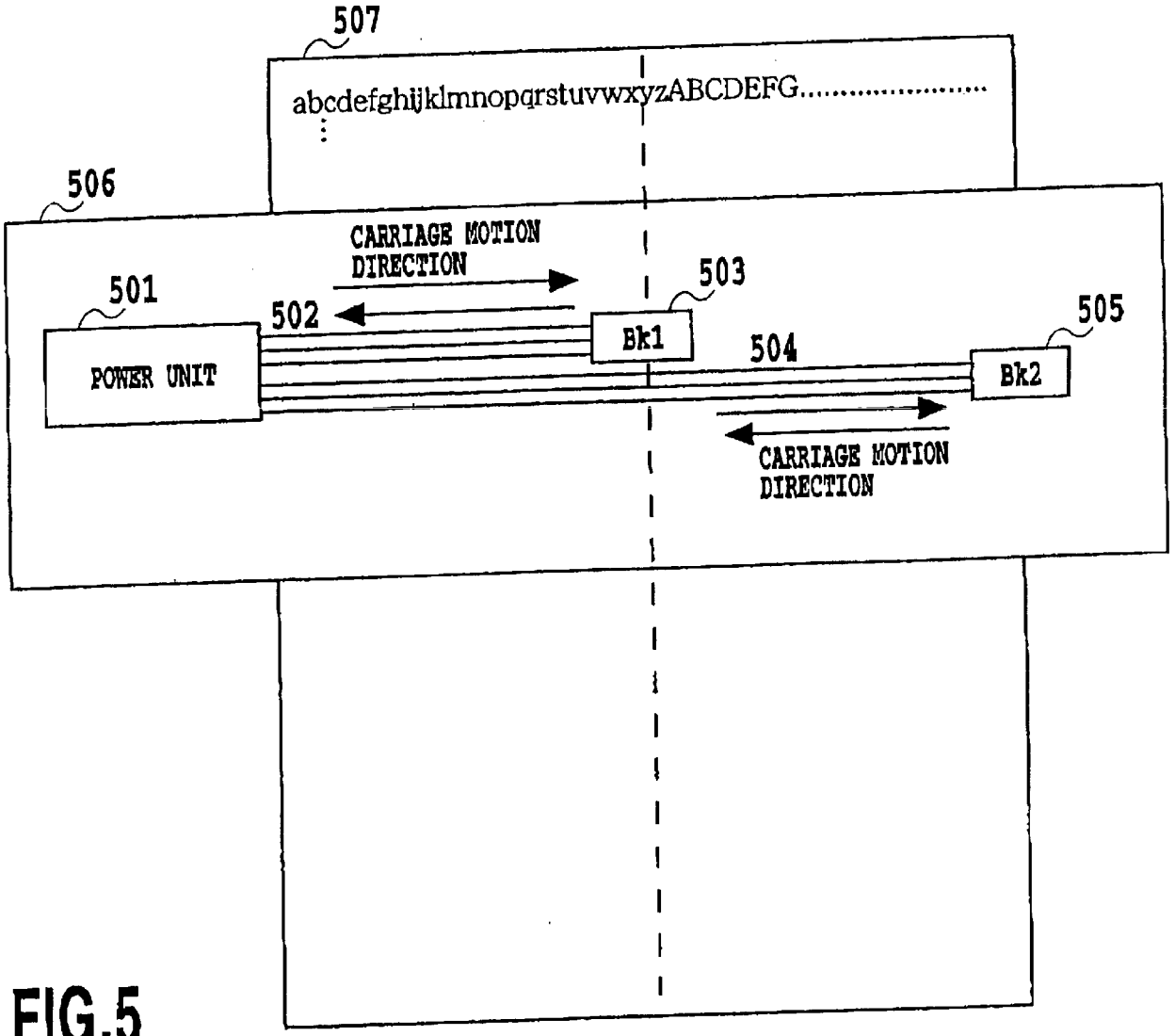
FIG. 5 is a schematic plan view of a second embodiment of the present invention.

FIG. 5 shows a schematic construction of the ink jet printing apparatus according to the second embodiment. The ink jet printing apparatus 506 has two carriages 503 and 505. These carriages perform printing operations by reciprocally scanning over different ranges that are defined by dividing the print medium 507 in half in the main scan direction. Hence, the power supply paths 502 and 504 have different lengths from each carriage to the power supply unit 501 and therefore different wiring resistances. This difference in wiring resistance is eliminated by increasing the width of the long power supply paths 504 to reduce their electric resistances down to those of the shorter power supply paths 502. The similar effect of making these wiring resistances equal may also be obtained by increasing the thickness of the wires of the long power supply paths 504.

By differentiating the wiring resistances it is possible to keep the ejection conditions uniform among different nozzles and realize a high-quality printing even when the energy supply path lengths differ from each other.

(Others)

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first,. one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and thirds bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed In Japanese Patent Application Laying-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used; for example, inks can be employed that solidify at a temperature lower than the room temperature and are softened or liquefied in the room temperature. This is because In the ink jet system, the ink is generally temperature adjusted in a range of 30° C.–70° C. so that the viscosity of the ink is maintained at such a value that the ink can be ejected reliably. In addition, the present invention can be applied to such apparatus where the ink is liquefied just before the ejection by the thermal energy as follows so that the ink Is expelled from the orifices in the liquid state, and then begins to solidify on hitting the recording medium, thereby preventing the ink evaporation, the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described In Japanese Patent Application Laying-open Nos. 54-56847 (1979) or 60-71260 (1985). The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet printing apparatus comprising:

a plurality of nozzles arrayed in a print head;

a plurality of energy generating means for generating an ejection energy to eject ink from the nozzles, the plurality of energy generating means being divided into a plurality of blocks, and the energy generating means in each block being capable of being driven simultaneously; and a drive control means for supplying an energy through energy supply paths to the energy generating means in each block;

wherein the drive control means supplies energy to at least one of the energy generating means in each respective block through an energy supply path other than the energy supply paths for the other energy generating means in each respective block, and wherein each energy supply path is connected to a corresponding electric source.

2. An ink jet printing apparatus according to claim 1, wherein the energy generating means convert an electric energy into an ejection energy, and each energy supply path is a power supply wire for supplying electricity to the energy generating means.

3. An ink jet printing apparatus according to claim 2, wherein the print head converts an electric energy into a thermal energy by the energy generating means, generates bubbles in ink by the thermal energy, and ejects ink from nozzles by an energy generated by the bubbles.

4. An ink jet printing apparatus according to claim 1, wherein an energy supply path in the print head running to a nozzle far from an energy supply source is formed with a wire of lower electric resistance than that of a wire of an energy supply path running to a nozzle near the energy supply source.

5. An ink jet printing apparatus according to claim 4, wherein the print head converts an electric energy into a thermal energy by the energy generating means, generates bubbles in ink by the thermal energy, and ejects ink from nozzles by an energy generated by the bubbles.

6. An ink jet printing apparatus according to claim 1, wherein the print head converts an electric energy into a thermal energy by the energy generating means, generates bubbles in ink by the thermal energy, and ejects ink from nozzles by an energy generated by the bubbles.

7. An ink jet printing apparatus comprising:

a plurality of nozzles arrayed in a print head; and a plurality of energy generating means for generating an ejection energy to eject ink from the nozzles;

wherein the print head having the energy generating means is mounted on each of a plurality of carriages that move on different moving paths, and a long power supply path connected to the print heads mounted on one of the carriages is formed with a wire material of a lower electric resistance than that of a wire material of a short power supply path connected to the print heads mounted on another carriage.

8. An ink jet printing apparatus according to claim 7, wherein the print head converts an electric energy into a thermal energy by the energy generating means, generates bubbles in ink by the thermal energy, and ejects ink from nozzles by an energy generated by the bubbles.

9. An ink jet printing method comprising the steps of:

dividing a plurality of energy generating means into a plurality of blocks, the energy generating means being adapted to generate an ejection energy to eject ink from nozzles, and the energy generating means in each block being capable of being driven simultaneously; and supplying energy through energy supply paths to the energy generating means in each block to perform printing;

wherein a control is performed to supply an energy to at least one of the energy generating means in each respective block through an energy supply path other than energy supply paths for supplying energy to other energy generating means in each respective block, and wherein each energy supply path is connected to a corresponding electric source.

10. An ink jet printing apparatus comprising:

a plurality of nozzles arrayed in a print head;

a plurality of energy generating means for generating an ejection energy to eject ink from the nozzles, the plurality of energy generating means being divided into a plurality of blocks, and the energy generating means in each block being capable of being driven simultaneously; and a drive control means for supplying an energy through energy supply paths to the energy generating means in each block;

wherein the drive control means supplies the energy to at least one of the energy generating means in each respective block through an energy supply path other than the energy supply paths for supplying energy to other energy generating means in each respective block, and wherein each energy supply path is connected to a corresponding electric power stabilizing circuit.

* * * * *

UNITED STATES PATENT AND TRADEMARK OFFICE

CERTIFICATE OF CORRECTION

PATENT NO. : 6,612,672 B2
DATED : September 2, 2003
INVENTOR(S) : Midori Yasuda

It is certified that error appears in the above-identified patent and that said Letters Patent is hereby corrected as shown below:

Title page,
Item [57], ABSTRACT,
Line 10, “f or” should read -- for --.

Column 1,
Line 29, “head,” should read -- heads, --.

Column 3,
Line 15, “Ink” should read -- ink --.

Column 4,
Line 56, “paper” should read -- paper. --.

Column 5,
Line 62, “Is” should read -- is --.

Column 6,
Line 5, “1-4 a” should read -- 1-4, a --.
Line 35, “stably” should read -- a stable --.
Line 60, “selector 220” should read -- selector 220. --.

Column 7,
Line 61, “block are” should read -- blocks are --.

Column 9,
Line 27, “first,.” should read -- first, --.
Line 32, “thirds” should read -- third, --.
Line 52, “In” should read -- in --.
Line 66, “consists” should read -- consist --.

UNITED STATES PATENT AND TRADEMARK OFFICE

CERTIFICATE OF CORRECTION

PATENT NO. : 6,612,672 B2
DATED : September 2, 2003
INVENTOR(S) : Midori Yasuda

It is certified that error appears in the above-identified patent and that said Letters Patent is hereby corrected as shown below:

Column 10,
Line 41, "In" should read -- in --.
Line 47, "Is" should read -- is --.
Line 57, "In" should read -- in --.

Signed and Sealed this

Third Day of February, 2004

JON W. DUDAS
*Acting Director of the United States Patent and Trademark Office*